US005887537A

United States Patent [19]

Panhorst et al.

[11] Patent Number: 5,887,537

[45] Date of Patent: Mar. 30, 1999

[54] METHOD AND APPARATUS FOR THE PRODUCTION OF A SEAM IN A WORKPLACE

[75] Inventors: Rainer Panhorst; Peter Cygon; Manfred Klöpper, all of Bielefeld, Germany

[73] Assignee: Durkopp Adler Aktiengesellschaft, Germany

[21] Appl. No.: 873,646

[22] Filed: Jun. 12, 1997

[30] Foreign Application Priority Data

Jun. 15, 1996 [DE] Germany ..... 196 23 975.3
Apr. 15, 1997 [DE] Germany ..... 197 15 558.8

[51] Int. Cl.[6] ..... D05B 53/00; D05B 29/12

[52] U.S. Cl. ..... 112/475.01; 112/253; 112/291

[58] Field of Search ..... 112/475.01, 291, 112/290, 300, 293, 296, 253, 292, 285, 294, 295, 297, 298

[56] References Cited

U.S. PATENT DOCUMENTS 3,696,770 10/1972 Dunne et al. ..... 112/252
4,077,342 3/1978 Steckenrider ..... 112/292
4,421,045 12/1983 Portilla ..... 112/288
4,478,163 10/1984 Keeton ..... 112/287
4,962,714 10/1990 Komori ..... 112/287
5,144,901 9/1992 Suzuki ..... 112/253
5,345,887 9/1994 Droste .
5,555,827 9/1996 Tanabe ..... 112/102.5

OTHER PUBLICATIONS

Leaflet, Durkopp Adler AG 504 (D/GB/F 11.90).

*Primary Examiner*—Michael A. Neas
*Assistant Examiner*—Tejash D Patel
*Attorney, Agent, or Firm*—Laff, Whitesel, Conte & Saret, Ltd.

[57] ABSTRACT

A sewing machine comprises a holding device, by means of which the front end of the needle thread can be clamped and held. Further, a cutter is available, by means of which the front end of the needle thread can be cut off directly over the workpiece.

20 Claims, 4 Drawing Sheets

METHOD AND APPARATUS FOR THE PRODUCTION OF A SEAM IN A WORKPLACE

BACKGROUND OF THE INVENTION

1. Field of the Invention

The invention relates to a method for the production of a seam in a workpiece, the seam comprising a starting point and an end point; the seam being produced by means of a sewing machine, which comprises a hook and a needle having an eye; the seam further comprising a needle thread supplied to the eye and a looper thread; and a front end of the needle thread extending out of the eye of the needle prior to the start of production of the seam; the method comprising the following steps: production of the seam; stopping the sewing machine with the needle outside the workpiece, the needle thread extending from the end point of the seam to the eye of the needle, and the looper thread extending from the end point of the seam toward the hook; cutting the needle thread by means of a first cutter and cutting the looper thread by means of a second cutter, short remaining threads remaining on the workpiece. The invention futher relates to an apparatus for putting the method into practice, the apparatus comprising a sewing machine which has a hook and a needle, driven to reciprocate up and down and having an eye, for the production of a seam in a workpiece, the seam comprising a needle thread supplied to the needle and a looper thread, the seam taking a course which has a starting point and an end point, and, prior to the start of production of the seam, a front end of the needle thread being provided that extends out of the eye of the needle; a driving motor for the sewing machine for driving and stopping the sewing machine with the needle out of the workpiece; a first cutter for the needle thread and a second cutter for the looper thread of the seam, the workpiece, after the cutting of the needle thread and the looper thread, having short remaining threads, and a control unit connected with the driving motor and the cutters.

2. Background Art

A sewing machine is known from a leaflet, Dürkopp Adler AG 504, imprint D/GB/F 11.90, putting into practice the method of the generic type of producing a two-thread lock stitch seam for a group of stitches, for instance a lock stich seam on safety belts. Such a stitch group consists of a number of stitches lined up to form a seam taking a given, closed course. Stitch groups of this type are required to provide for a certain solidity of seam and to offer the possibility that any thread tail pieces produced are cut off as short as possible where extending out of the workpiece. To this end, the sewing machine is provided with thread cutters working close to the workpiece surfaces and being embodied for instance as thread burn-cutters.

For the requirements of solidity of seam to be fulfilled, very tight stitches must be produced by the needle thread being pretensioned correspondingly. For this to be carried out controllably, attention must be drawn to the fact that the friction occurring during stitching is not too high between the thread and the workpiece, which is again influenced by the thickness of the needle. This is opposed by the fact that too low a friction between the thread and the workpiece will prevent regular stitching at the beginning of the seam.

So as to obtain sufficient solidity of seam, the beginning and the end of the seam are usually secured against becoming undone. A way of securing a seam consists in that stitches are produced at the beginning and end of the seam, having a reduced stitch length or no stitch length at all. Other ways of securing a seam consist in that the stitches produced at the beginning and end of a seam overlap each other. When synthetic threads are used, for instance in safety belts, additional securing of a seam results from the fact that the tail pieces cut off by a thread burn-cutter are thickened.

Owing to the conditions described, in these stitch groups, an accumulation of threads will inevitably result at the joint of the seam, i.e. where the starting point and the end point of the seam are close to each other. This will affect the quality and appearance of the stitch group, which becomes especially unpleasant when thread of some thickness, for instance of a diameter of 0.8 mm, are used.

U.S. Pat. No. 5,345,887 teaches a method of producing a seam in which, at the beginning of seam production, a thread clamp acts periodically on the thread supplied to the needle from a thread supply, withdrawing the thread by a certain length so that any excess of needle thread is avoided to accumulate on the lower side of the workpiece, this aiming at ensuring an impeccable appearance of the seam on the lower side of the workpiece. In this case, a needle-thread end piece is produced at the starting point of the seam, which leads through the workpiece, there however being insufficiently secured, so that it is necessary, for a certain solidity of seam to be ensured, to sew again along the starting point of the seam.

SUMMARY OF THE INVENTION

It is the object of the invention to develop a method and an apparatus according to the invention in such a way that at the beginning and end of the seam, the needle thread can be cut as short as possible where extending out of the workpiece and that nevertheless a solid stitch arrangement is attained right from the first stitch.

This object is attained by a method wherein the front end of the needle thread is held by a holding device prior to the start of and at least during the production of the starting stitches of the seam, the front end extending from the starting point toward the holding device and through the working range of the first cutter; and wherein the front end is cut by means of the first cutter. The method according to the invention helps avoid any excess of thread to accumulate, thus precluding the thickening of the stitch group and reliably securing the seam while simultaneously the threads are cut off short. Securing the seam takes place by the front end of the needle thread being held at least during the production of the starting stitches so that at the end of seam production, it will stand out from the workpiece where it is cut off, a short remaining piece being kept that will be sufficient for a secure seam. The front end being secured, it is now possible to use comparatively thick needles so that tight stitches can be produced. Further, holding the front end ensures absolutely reliable stitching right from the first stitch. Further, it is of special advantage that the seam has short remaining pieces, this being attained without any decrease of machine efficiency by the front end and the tail piece of the needle thread being cut in a single operation of the thread cutter.

The method, according to which the front end of the needle thread is held during the production of the entire seam and during the working motion of the first cutter with the front end and the tail piece of the needle thread being cut simultaneously, allows the front end of the needle thread to be positioned very reliably even after the production of some starting stitches, i.e. during the entire production of the seam, so that the starting thread is held even more reliably. This permits even comparatively thin threads to be used.

Moreover, the front end and the tail piece of the needle thread are cut through by a single operation of the cutter.

The method according to the invention can be used in the case of two-thread lock stitch seams as well as chain stitch seams. It can be used not only in the case of closed groups of stitches, but also in seams with the beginning and end of the seam distant from each other, the front end of the needle thread being held only during the first stitches of the seam produced, the front end of the needle thread being cut, the seam being finished, and the tail piece of the needle thread being cut.

An apparatus serves for putting the method into practice, in which a holding device for the front end of the needle thread is provided on the sewing machine and connected with the control unit in a manner to be triggered by the latter for the front end of the needle thread to be held prior to the start of production of the seam. This apparatus is distinguished by a low number of components and consequently by low manufacturing costs and reliable operation.

When synthetic threads are used, it is advantageous that the first cutter and the second cutter are thread burn-cutters.

Another advantageous improved embodiment of the apparatus consists in that a thread feeder is provided, which is connected with the control unit in a manner to be triggered by the latter and which, after termination of the seam and prior to the working motion carried out by the first cutter, can be applied to the tail piece of the needle thread. The thread feeder ensures that the threads to be cut are positioned at defined places within the working range of the cutter and that the needle-thread front end newly created after the cutting operation is directed toward the holding device.

The embodiment, according to which the holding device is connected with a suction device, allows the needle-thread front end to be reliably received in the holding device in a simple and operationally safe manner. Safe holding of the front end is attained by the feature consisting in that the holding device comprises a power transmitter clamping the front end.

When the holding device comprises a flexible hose and the hose forms part of the holding device, the power transmitter being formed so as to compress the cross-section of the hose at a contact point, this will provide for simple construction to be realized at a low cost. Simultaneously, it is ensured that the holding device is free from edges inside, this increasing the safety of operation. Troublefree operation is obtained in that the suction device and the holding device are connected with the control unit in a manner to be alternately activated, the suction device being activated for a short time after the front end of the needle thread is cut. The embodiment, according to which the holding device is mounted on the press foot, can be used with special advantage when a seam is sewn, of which the starting point and end point are not adjacent to each other.

Further features, advantages and details of the invention will become apparent from the ensuing description of an exemplary embodiment, taken in conjunction with the drawing.

DESCRIPTION OF THE PREFERRED EMBODIMENT

Figure 1:
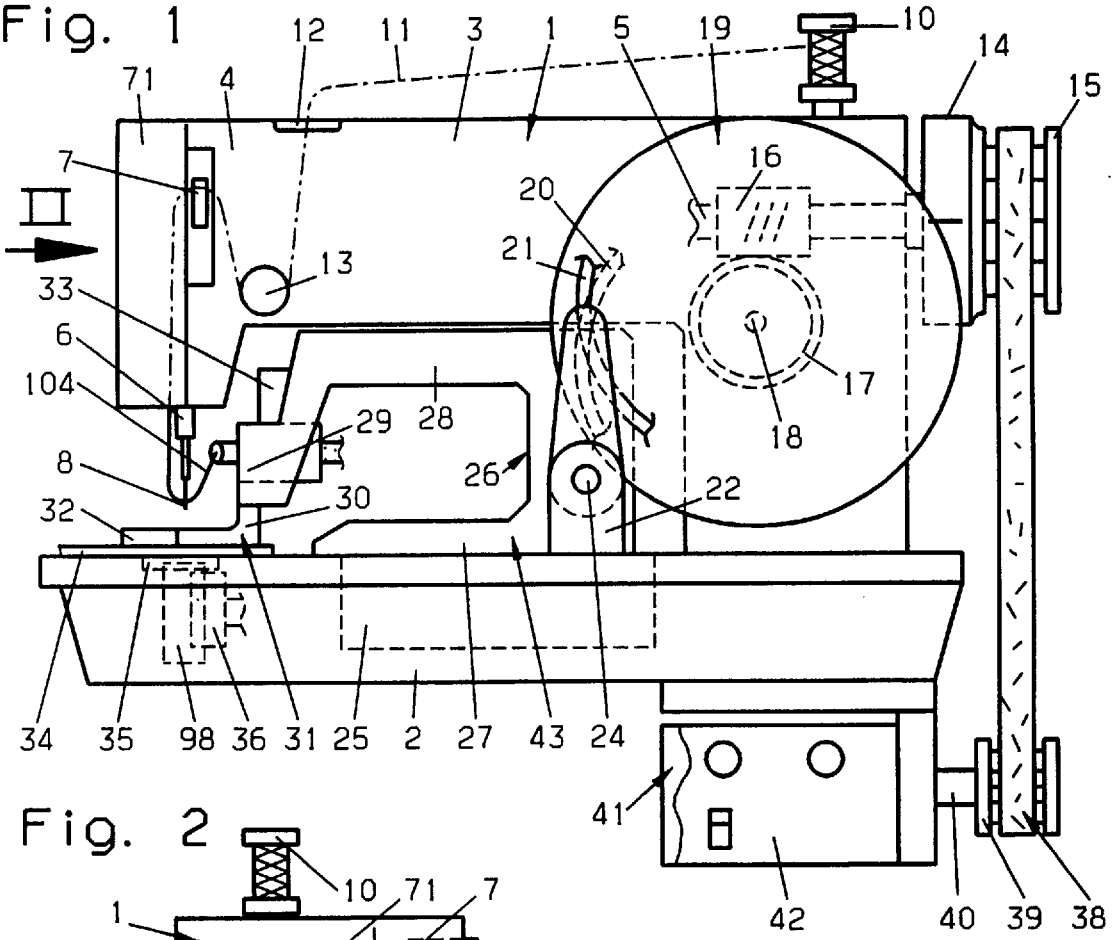
FIG. 1 is a front view of a sewing machine.

A sewing machine 1 is customarily structured to have a base plate 2 and an angular arm 3 which is fixed to the base plate 2 and ends in a bead 4. In the arm 3, an arm shaft 5 is rotatably run, ending in the head 4, where it is connected with a needle bar 6 in a manner driven by a crank drive (not shown); the needle bar 6 is disposed in the head 4 for reciprocating displacement up and down. The crank drive is in driving connection with a take-up lever 7. The lower end of the needle bar 6 that is turned toward the base plate 2 is equipped with a needle 8 having an eye 9.

On the arm 3, provision is made for a bobbin constituting a thread supply 10 for a needle thread 11. According to FIG. 1, the needle thread 11 extends from the thread supply 10 through an eye 12 to the thread tightener 13, from where it runs through a hole of the take-up lever 7 down to the needle 8 and from there through the eye 9.

The free end of the arm shaft 5 extends out of the arm 3, there being tightly joined to a handwheel 14, on which a timing belt pulley 15 is formed. Further, the arm shaft 5 is provided with a worm 16 which meshes with a worm wheel 17. The worm wheel 17 is mounted on a shaft 18 which, according to FIG. 1, is rotatably run in the arm 3 below the arm shaft 5 and at right angles to the latter. According to FIG. 1, the shaft 18 extends out of the arm 3 toward the operator's side, where it is tightly joined to a cam 19 having threads 20 and 21. These threads each cooperate with a driving lever 22 and 23, rollers (not designated in detail) engaging with play in the threads 20 and 21. Attention is drawn to the fact that the threads 20, 21, of which only portions are roughly outlined in FIG. 1, extend completely, i.e. over 360°, on the front sides of the cam 19, i.e. they exhibit a continuous control profile.

The driving levers 22, 23 are pivotably supported an an axis 24, the free arms of the driving levers 22, 23 extending downward through an opening (not shown) through the base plate 2. The driving levers 22, 23 are in driving connection with transmission members which are part of a transmission 25 only roughly outlined in FIG. 1. The transmission 25 is in driving connection with a frame 26 which is C-shaped according to FIG. 1, and the lower leg 27 of which is displaceable in the plane of the base plate 2 and supported on the latter, and the upper leg 28 of which supports itself displaceably on the lower side of the arm 3, i.e. the frame 26 is displaceable relative to the base plate 2 and the arm 3. At its end turned toward the needle 8, the upper leg 28 of the frame 26 is provided with a sliding bearing 29 in which a leg 30 of a press foot 31 is displaceably run. The latter comprises a bottom 32 which extends parallel to the base plate 2. The presser foot 31 is in driving connection with a pneumatic cylinder 33 which is disposed above the sliding bearing 29. The structure specified is dimensioned such that the press foot 31 can be moved up and down by the pneumatic cylinder 33 so that it is capable of pressing a workpiece 34 against the base plate 2 by means of its bottom 32.

In the portion below the needle 8, a needle plate 35 is mounted on the base plate 2 which is customarily provided with a stitch hole for the needle 8 to pass through. Under the needle plate 35, a hook 36 is rotatably disposed in the base plate 2, comprising a looper thread supply 37. The hook 36 is in driving connection with the arm shaft 5 by way of a drive extending within the arm 3. A timing belt 38 is placed on a timing belt pulley 15, its free end wrapping a timing belt pulley 39. This is tightly mounted on the shaft 40 of a driving motor 41 which is a position-drive motor fixed to the base plate 2. An electronic control unit 42 is disposed beside the driving motor 41.

The transmission 25, the driving levers 22, 23, the cam 19 driving the latter and the frame 26 form a guide 43. This is in driving connection with the press foot 31 which forms a workpiece holder 44 for the workpiece 34.

Figure 7:
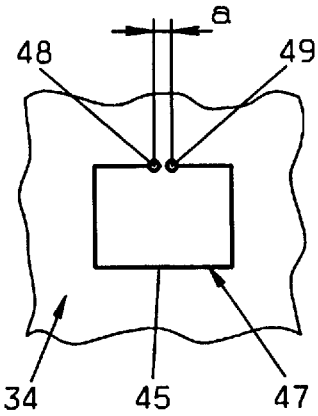
FIG. 7 is a diagrammatic view of a group of stitches.
Figure 6:
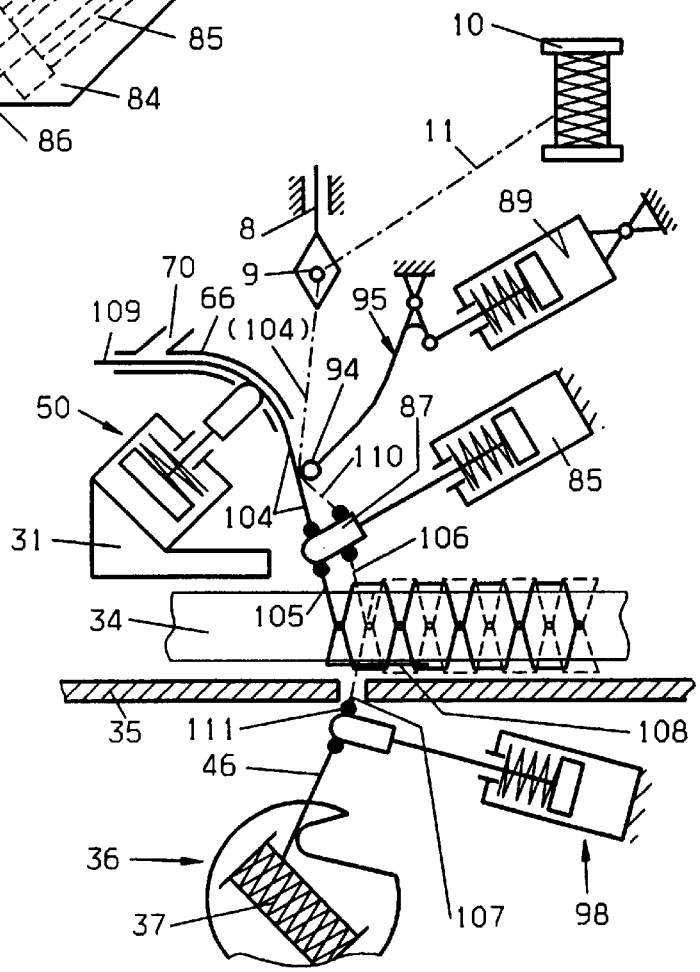
FIG. 6 is a diagrammatic view of the stitch-producing portion of the sewing machine.

As seen in FIGS. 6 and 7, the sewing machine 1 so far specified permits the production of a two-thread lock stitch seam 45 in the workpiece 34, the two-thread lock stitch seam 45 comprising the needle thread 11 and a looper thread 46 supplied from the looper thread supply 37. In the workpiece 34, the two-thread lock stitch seam 45 takes a given form as determined by the course of the threads 20, 21 in the cam 19. The threads 20, 21 are formed in the cam 19 so as to give the conception of a closed seam, to which is allocated a certain number of stitches so that the seam arrangement can also be designated as a group of stitches 47. This stitch group 47 comprises a starting point 48 and an end point 49 disposed close to each other. For better understanding, the points 48, 49 are illustrated at a distance a in FIG. 7. In stitch groups put into practice, the points 48, 49 are frequently disposed such that the ending parts of a seam overlap for reasons of tightness, the two points 48, 49 then having a small distance a in the range of as many as 6 mm.

Figure 4:
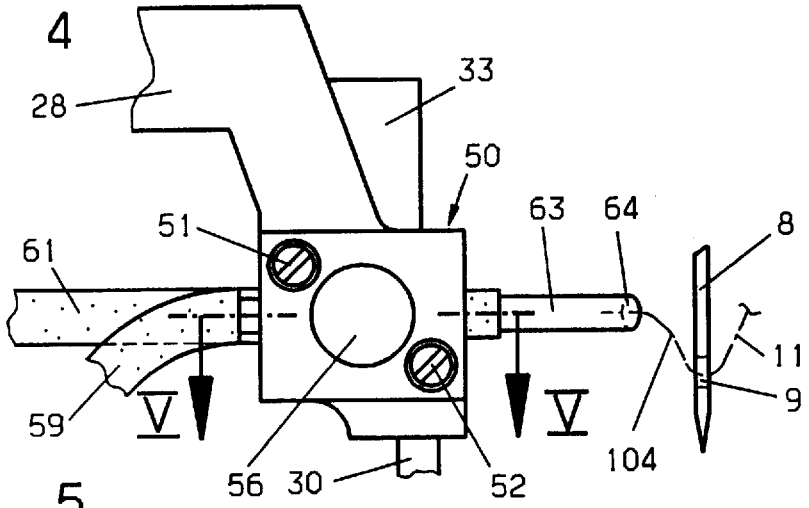
FIG. 4 is a view on part of the sewing machine according to the arrow IV of FIG. 2 on an enlarged scale.
Figure 5:
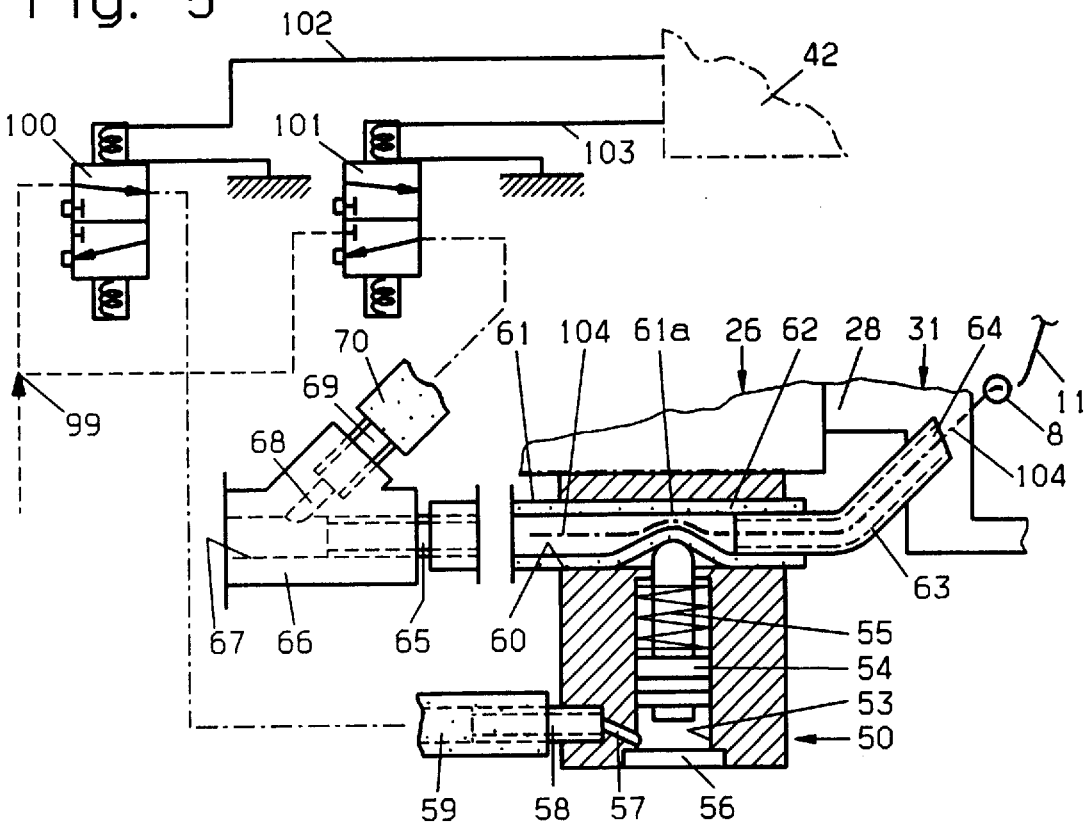
FIG. 5 is a sectional view on the line V—V of FIG. 4 on an enlarged scale and in combination with a pneumatic drive.

According to FIGS. 4 and 5, a holding device 50 is mounted on the upper leg 28 by means of screws 51, 52. The holding device 50 has a block-type structure and is provided with a cylindrical chamber 53, in which a piston 54 is displaceable against the load of a spring 55. Externally, the cylindrical chamber 53 is closed air-tight by a calked cover 56. A hole 57 terminates in the proximity of the cover 56 and is connected with a flexible air hose 59 by way of a piece of pipe 58. The arrangement of the spring-loaded piston 54 in the cylindrical chamber 53 constitutes a simply working pneumatic cylinder which is a power transmitter.

Further, the holding device 50 has a transverse hole 60, which extends approximately at right angles to the cylindrical chamber 53 and in which a flexible hose 61 is disposed, the front end 62 of which is secured against axial displacement owing to the overdimension of a pipe 63 pressed into it. The pipe 63 comprises an elbowed portion with an aspiration aperture 64. By way of a pipe 65, the free end of the hose 61 is connected to a suction device 66, which in known manner comprises a straight outlet hole 67 and a hole 68 opening therein at an acute angle and which is joined to a hose 70 by way of a pipe 69.

The design of the holding device 50 is such that upon actuation of the piston 54 by compressed air supplied from a compressed-air source through the air hose 59, the piston 54 is movable in the direction toward the hose 61 against the action of the spring 55 so that the hose 61 is squeezed in, thus being compressed in cross-section, which produces a contact point 61*a*.

Figure 2:
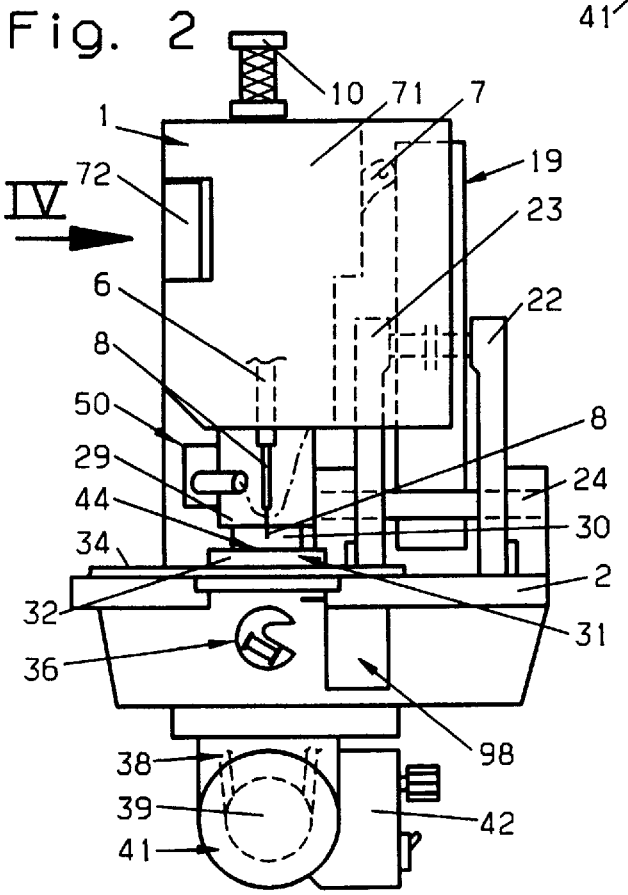
FIG. 2 is a side view of the sewing machine according to the arrow II of FIG. 1.
Figure 3:
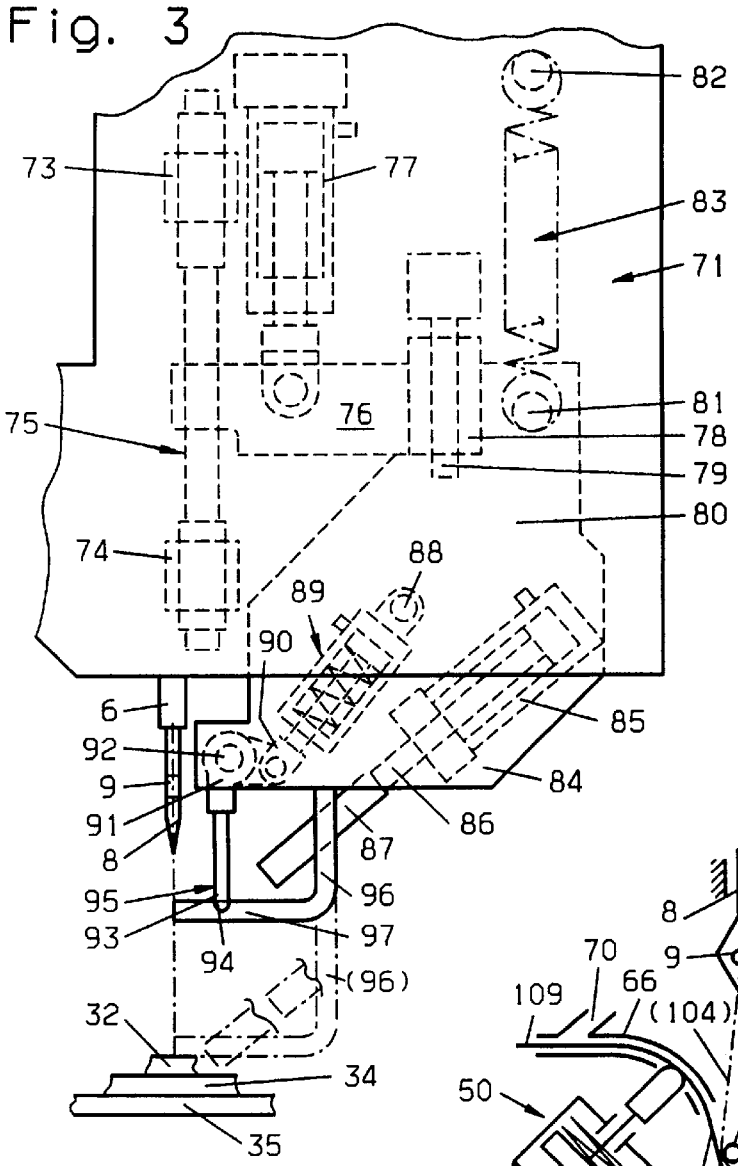
FIG. 3 is an illustration of part of the view seen in FIG. 2 on an enlarged scale.

According to FIGS. 1 and 2, the head 4 of the sewing machine 1 is closed by a saucer-type cover 71 which is fixed to the arm 3 by way of a hinge 72. As seen in FIG. 3, a bar 75 is situated within the cover 71 and displaceably run in bearings 73, 74 and disposed substantially parallel to the needle bar 6. A lever 76 is mounted on the bar 75 and articulated to a working cylinder 77. The working cylinder 77 is a simply working pneumatic cylinder, itself mounted on the cover 71. A sliding beating 78 is located at the free end of the lever 76, receiving with play a bar 79 mounted on the cover 71.

A plate 80 is dispsed on the lever 76, receiving a bolt 81. Further, the cover 71 is provided with a bolt 82. The ends of a prestressed tension spring 83 are suspended on the bolts 81, 82. The plate 80 has a portion 84 extending in the direction toward the base plate 2, a simply working, spring resetting pneumatic cylinder 85 being fixed to the portion 84.

A thread cutter 87 is mounted on the piston rod 86 of the pneumatic cylinder 85, which in this case is a thread burn-cutter. The thread burn-cutter has a U-shaped, bent sheet (not shown), which is electrically connected to a current supply for high-voltage current, when required, to flow through it and heating it. Thread burn-cutters of this type are generally known.

Further, a bolt 88 is provided on the plate 80, a simply working, spring resetting pneumatic cylinder 89 being articulated to the bolt 88. The piston rod 90 of the working cylinder 89 is articulated to a lever 91, which is pivotably supported on a bolt 92 disposed on the plate 80. Further, the lever 91 is provided with an arm 93 of wire, the end of which turned toward the base plate 2 having an elbowed thread feeder section 94, which extends substantially parallel to the arm shaft 5. The described arrangement of the arm 93 with the section 94 and the associated driven member form a thread feeder 95. The thread feeder 95 is disposed such that, in its position of rest, it permits the sewing machine 1 and in particular the needle 8 to work unimpeded; that, when performing its working motion by being pivoted about the bolt 92, it passes closely under the needle 8 which is stopped in the upper dead center; and that it gets into contact with two sections of the needle thread 11 to be cut and deflects them.

Finally, an elbowed bow 96 is mounted on the plate 80, having a lower elbow section 97. The described arrangement of the plate 80 on the cover 71 is such that the cutter 87 together with the thread feeder 95 and the bow 96 can be moved into an upper and a lower position. While the upper position is shown in solid lines in FIG. 3, the lower position is outlined by the dot-dashed bow 96. In this lower position, the lower section 97 of the bow 96 supports itself on the upper side of the bottom 32 of the press foot 31. In this way, the lower position of the cutter 87 is fixed in relation to the workpiece 34 clamped by the press foot 31, i.e. it is suited to the thickness of the workpiece 34. As regards the lower position, FIG. 3 roughly outlines that the cutter 87, likewise by reason of the position of the working cylinder 85, is movable into an extracted and a retracted dot-dashed position. As diagrammatically outlined in FIG. 1, the sewing machine 1 is equipped with a cutter 98 in the vicinity of the hook 36, which is again a thread cutter similar to the cutter 87 described above and which can be triggered when necessary for the looper thread 46 to be cut.

According to FIG. 5, a compressed-air line 99 actuated by a compressed-air source (not shown) is connected with valves 100, 101 which, by spring load or electrically, are movable into two positions of actuation. By way of the air hose 59, the holding device 50 is connected with the valve 100 so that the holding device 50 can be opened or closed. According to the diagrammatic representation of FIG. 5, the hose 70 is connected with the valve 101, the structure and triggering of which corresponds to the valve 100. The valves 100, 101 are connected with the control unit 42 by way of electric lines 102, 103. Equally, the pneumatic cylinders 33, 77, 85, 89 mentioned above can be triggered by the control unit 42 by way of control elements (not shown).

The operation of the sewing machine 1 is specified below as follows:

It is assumed that the sewing machine 1 is in a basic position, a workpiece 34 being clamped under the press foot 31, the plate 80 being in its upper position, the pneumatic cylinders 85, 89, 98 being in their positions of rest, the arm shaft 5 being in a position in which the needle has taken its uppermost position, and the needle thread 11 being threaded so that a front end 104 reaches out of the eye 9 of the needle 8 by a length of approximately 2 cm, this front end 104, as a result of the preceding activation of the suction device 66, being situated within the hose 61, there being clamped at the contact point 61*a* by the triggering of the holding device 50. (FIG. 5)

Following the operator's starting command, the sewing machine 1 sews a two-thread lock stitch seam 45 in the workpiece 34, which begins at the starting point 48. When the arm shaft 5 makes its first rotation, the hook 36 seizes the front end 104 of the needle thread 11, drawing it. However, because of the clamping arrest in the holding device 50, the front end 104 is prevented from being pulled down completely to the side of the workpiece 34 that is turned toward the hook 36 so that the first stitch of the needle 8 gives a normally sewn two-thread lock stitch, i.e. a solid first two-thread lock stitch is produced.

Producing the two-thread lock stitch seam 45 goes on while the workpiece holder 44 moves the workpiece 34 relative to the needle 8 that is driven to reciprocate up and down. The front end 104 remains in the condition clamped in the holding device 50. This is possible due to the fact that the holding device 50 is rigidly mounted on the frame 26 so that the motion imposed on the frame 26 by the guide 43 is performed by the workpiece holder 44 holding the workpiece 34 as well as by the holding device 50, i.e. the allocation of the holding device 50 relative to the workpiece 34 remains unmodified.

Once the group of stitches 47 is finished in the end point 49, the sewing machine 1 is stopped so that the needle 8 is in its uppermost position. Then the control unit 42 prompts the working cylinder 77 to be triggered so that the plate 80, against the load of the tension spring 83, is moved from its upper position into its lower position until the lower elbow portion 97 rests on the upper side of the bottom 32, thus stopping the downward motion of the plate 80. Then the control unit 42 prompts the thread feeder 95 to be triggered so that at the end of the latter's vibrating motion, the section 94 of the thread feeder 95 seizes and deflects the front end 104 and the tail piece 110 of the needle thread 11 that extends toward the eye 9 of the needle 8, as seen in FIG. 6.

Figure 8:
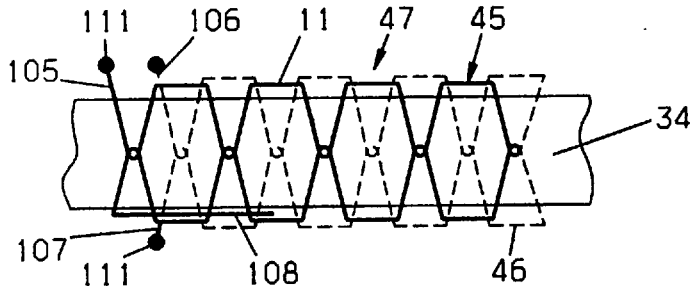
FIG. 8 is a diagrammatic illustration of the stitch group on an enlarged scale.

Then the control unit 42 triggers the pneumatic cylinder allocated to the cutters 87 and 98. The constructive arrangement of the thread cutter 87 and the thread feeder 95 ensures that the sections of the needle thread 11 extending from the points 48, 49 of the workpiece 34, i.e. the front end 104 and the tail piece 110, run through the working range of the cutter 87. Actuation of the cutters 98, 87 ensures that the looper thread 46 on the one hand and the front end 104 and the tail piece 110 of the needle thread 11 on the other are cut through directly where they leave the workpiece 34. This moment is diagrammatically outlined in FIG. 6. According to FIG. 8, remaining threads 105, 106, and 107 have thus been produced on the workpiece 34. As further outlined diagrammatically, a front end 108 of the looper thread 46 is covered by the threads of the first stitches of the two-thread lock stitch seam 45.

After a short stop of the thread cutters 87, 98 with current flowing through them and heating them for the synthetic threads to melt thoroughly, the control unit 42 causes the cutters 87, 98 to withdraw into their positions of rest. Simultaneously, a short reversal of the valves 100, 101 takes place, engendering a short reversal of the holding device 50 and actuation by air of the suction device 66, so that a remaining piece 109 cut off the front end 104 is sucked out of the holding device 50. As a result of the suction effect of the suction device 66, another ensuing front end 104 of the needle thread 11 is simultaneously sucked into the holding device 50. The aspiration of the needle thread front end 104 is supported by the fact that the thread feeder 95 deflects the front end 104 in the direction toward the aspiration aperture 64.

The described production of the two-thread lock stitch seam 45, which is distinguished by threads (looper thread and needle thread) being cut off nearly directly on the upper sides of the workpiece 34, is secured against becoming undone by stay stitches disposed at the starting and end points 48, 49.

Figure 9:
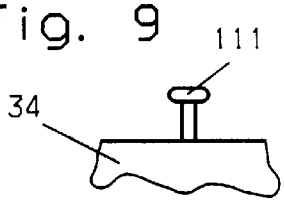
FIG. 9 is an illustration, on an enlarged scale, of a portion of the group of stitches seen in FIG. 8.

The use of synthetic threads provides for another advantage, because thickenings 111 will occasion at the cut ends after the cutting operation by cutters in the form of thread burn-cutters. In this way, the two-thread lock stitch seam 45 is additionally secured against becoming undone, as seen among other things in FIG. 9.

Figure 10:
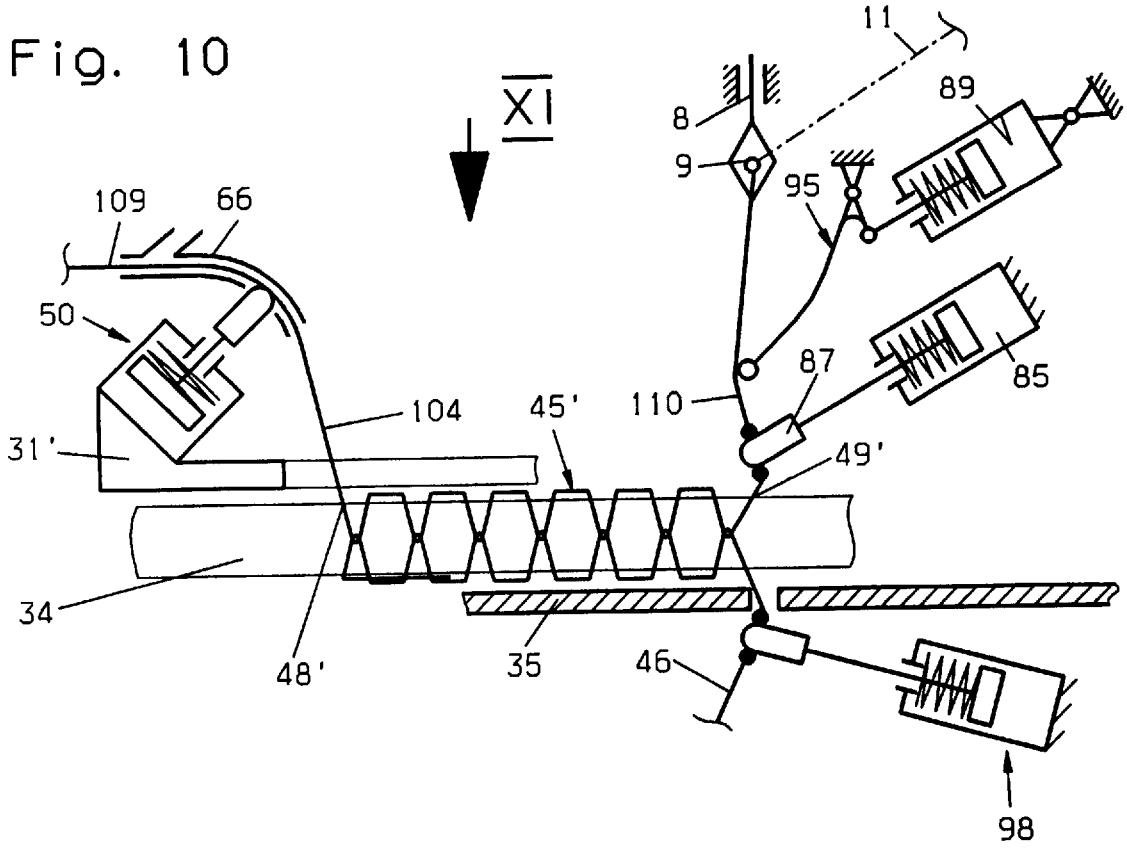
FIG. 10 is an illustration, corresponding to FIG. 6, of another embodiment of a sewing machine according to the invention.
Figure 11:
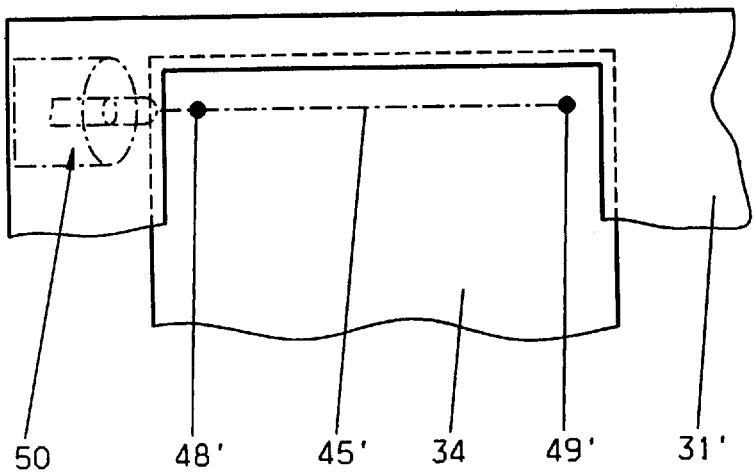
FIG. 11 is a partial plan view of the embodiment according to FIG. 10.

FIGS. 10 and 11 explain how the front end 104 and the tail piece 110 of the needle thread 11 are cut, when a seam 45' is sewn in the workpiece 34, the starting point 48' of which and the end point 49' of which are not close to, but remote from, each other. In this case, the workpiece 34 is held by a press foot 31' forming a workpiece holder 44. The holding device 50 is mounted on the press foot 31'. In this case, the front end 104 of the needle thread 11 is clamped in the holding device 50 during the production of the entire seam 45'. Subsequently, the tail piece 1 10 of the needle thread 11 is cut as described by means of the cutter 87. Then, with the sewing machine at standstill, the workpiece holder 44, inclusive of the workpiec 34, returns to the initial position so that the clamped front end 104 of the needle thread 11 again arrives in the working range of the cutter 87. Then the front end 104 is cut and the remaining piece 109 is sucked off in the way specified. Cutting the looper thread 46 has been carried out in the manner already described.

Furthermore, a mode of operation is conceivable, in which the production of the seam 45' is interrupted after two stitches and the front end 104 of the needle thread 11 is cut at the starting point 48' by means of the cutter 87. Then the seam 45' is finished and the tail piece 110 of the needle thead 11 is cut in the manner described. This mode of operation is feasible with a sewing machine in which the holding device 50 is mounted on the machine housing, i.e. stationarily, and in which the press foot 31' is moved while the seam 45' is produced and during idle running, i.e. during a motion of the press foot 31' without sewing.

Even though the description so far refers to two-thread lock stitch seams, the sewing machine according to the invention and the method according to the invention can be used also in the case of other seams such as chain stitch seams.

What is claimed is:

1. A method for the production of a seam (45, 45') in a workpiece (34), the seam (45, 45')

comprising a starting point (48, 48') and an end point (49, 49'), being produced by means of a sewing machine (1), which comprises a hook (36) and a needle (8) having an eye (9), comprising a needle thread (11) supplied to the eye (9) from a thread supply (10) and a looper thread (46), and a front end (104) of the needle thread (11) hanging out of the eye (9) of the needle (8) prior to the start of production of the seam (45), the method comprising the following steps:

forming a series of stitches, stopping the sewing machine (1) with the needle (8) outside the workpiece (34), the needle thread (11) extending from the end point (49; 49') of the seam (45, 45') to the eye (9) of the needle (8), and the looper thread (46) extending from the end point (49, 49') of the seam (45, 45') toward the hook (36), cutting the needle thread (11) above the workpiece (34) by means of a first cutter (87) disposed above the workpiece (34) and cutting the looper thread (46) below the workpiece (34) by means of a second cutter (98) disposed below the workpiece (34), short remaining threads (106, 107) remaining on the workpiece (34), wherein the front end (104) of the needle thread (11) is held over the workpiece (34) by a holding device (50), which is disposed directly over the workpiece (34), prior to the start of and at least during the production of some first stitches of the seam (45, 45'), the front end (104) extending from the starting point (48, 48') toward the holding device (50) and through the working range of the first cutter (87), and the front end (104) is cut by means of the first cutter (87).

2. A method according to claim 1, wherein the front end (104) of the needle thread (11) is held during the production of the entire seam (45, 45')

and during the working motion of the first cutter (87) with the front end (104) and a tail piece (110) of the needle thread (11) being cut simultaneously.

3. A method according to claim 1, wherein the front end (104) of the needle thread (11) is held only during some first stitches of the seam (45, 45') produced, the front end (104) of the needle thread (11) is cut, the seam (45, 45') is finished, and a tail piece (110) of the needle thread (119) is cut.

4. A method according to claim 2, wherein the starting point (48) and the end point (49) of the seam (45) are positioned relative to each other such that, once the seam (45) is finished, the front end (104) and the tail piece (110) of the needle thread (11) reach through a range of operation of the first cutter (87).

5. An apparatus for the production of a seam (45, 45') in a workpiece (34), comprising:

a sewing machine (1) comprising a hook (36) and a needle (8), driven to reciprocate up and down and having an eye (9), for the production of the seam (45, 45') in the workpiece (34), the seam (45, 45') comprising a needle thread (11) supplied to the needle (8) from a thread supply (10) and a looper thread (46), the seam (45, 45') taking a course which has a starting point (48, 48') and an end point (49, 49'), and prior to the start of production of the seam (45, 45'), a front end (104) of the needle thread (11) being provided that hangs out of the eye (9) of the needle (8), a needle plate (35) supporting the workpiece (34) during production of the seam (45, 45')

a driving motor (41) for the sewing machine (1) for driving and stopping the sewing machine (1) with the needle (8) out of the workpiece (34), a first cutter (87), disposed above the needle plate (35), for the needle thread (11) and a second cutter (98), disposed below the needle plate (35) for the looper thread (46) of the seam (45), the workpiece (34), after the cutting of the needle thread (11) and the looper thread (46), having short remaining threads (106, 107), and a control unit (42) connected with the driving motor (41) and the cutters (87, 98), wherein a holding device,(50) for the front end (104) of the needle thread (11) is provided on the sewing machine (1) directly above the needle plate (35) and connected with the control unit (42) in a manner to be triggered by the latter for the front end (104) of the needle thread (11) to be held prior to the start of production of the seam (45, 45').

6. An apparatus according to claim 5, wherein the first cutter (87) is a thread burn-cutter.

7. An apparatus according to claim 5, wherein the second cutter (98) is a thread burn-cutter.

8. An apparatus according to claim 5, wherein a thread feeder (95) is provided, which is connected with the control unit (42) in a manner to be triggered by the latter and which, after termination of the seam (45, 45') and prior to the working motion carried out by the first cutter (87), can be applied to the tail piece (110) of the needle thread (11).

9. An apparatus according to claim 5, wherein the holding device (50) is connected with a suction device (66).

10. An apparatus according to claim 9, wherein the suction device (66) and the holding device (50) are connected with the control unit (42) in a manner to be alternately activated, the suction device (66) being activated for a short time after the front end (104) of the needle thread (11) is cut.

11. An apparatus according to claim 5, wherein the holding device (50) comprises a power transmitter clamping the front end (104).

12. An apparatus according to claim 11, wherein the holding device (50) comprises a flexible hose (61) and wherein the hose (61) forms part of the holding device (50), the power transmitter being formed so as to compress the cross-section of the hose (61) at a contact point (**61*a***).

13. An apparatus for the production of a seam (45, 45') in a workpiece (34), comprising:

a sewing machine (1) comprising a hook (36) and a needle (8), driven to reciprocate up and down and having an eye (9), for the production of the seam (45 45') in the workipiece (34), the seam (45, 45') comprising a needle thread (11) supplied to the needle (8) from a thread supply (10) and a looper thread (46), the seam (45, 45') taking a course which has a starting point (48, 48') and an end point (49, 49'), and prior to the start of production of the seam (45, 45') a front end (104) of the needle thread (11) being provided that hangs out of the eye (9) of the needle (8), a needle plate (35) supporting the workpiece (34) during production of the seam (45, 45')

a driving motor (41) for the sewing machine (1) for driving and stopping the sewing machine (1) with the needle (8) out of the workpiece (34), a first cutter (87), disposed above the needle plate (35), for the needle thread (11) and a second cutter (98), disposed below the needle plate (35) for the looper thread (46) of the seam (45), the workpiece (34), after the cutting of the needle thread (11) and the looper thread (46), having short remaining threads (106, 107), and a control unit (42) connected with the driving motor (41) and the cutters (87, 98), wherein a holding device (50) for the front end (104) of the needle thread (11) is provided on the sewing machine (1) directly above the needle plate (35) and connected with the control unit (42) in a manner to be triggered by the latter for the front end (104) of the needle thread (11) to be held prior to the start of production of the seam (45, 45'), and wherein the holding device (50) is mounted on the presser foot (31').

14. An apparatus according to claim 13, wherein the first cutter (87) is a thread burn-cutter.

15. An apparatus according to claim 13, wherein the second cutter (98) is a thread burn-cutter.

16. An apparatus according to claim 13, wherein a thread feeder (95) is provided, which is connected with the control unit (42) in a manner to be triggered by the latter and which, after termination of the seam (45, 45') and prior to the working motion carried out by the first cutter (87), can be applied to the tail piece (110) of the needle thread (11).

17. An apparatus according to claim 13, wherein the holding device (50) is connected with a suction device (66).

18. An apparatus according to claim 13, wherein the holding device (50) comprises a power transmitter clamping the front end (104).

19. An apparatus according to claim 18, wherein the holding device (50) comprises a flexible hose (61) and wherein the hose (61) forms part of the holding device (50), the power transmitter being formed so as to compress the cross-section of the hose (61) at a contact point (61*a*).

20. An apparatus according to claim 17, wherein the suction device (66) and the holding device (50) are connected with the control unit (42) in a manner to be alternately activated, the suction device (66) being activated for a short time after the front end (104) of the needle thread (11) is cut.

* * * * *